US006250078B1

(12) United States Patent
Amendola et al.

(10) Patent No.: US 6,250,078 B1
(45) Date of Patent: Jun. 26, 2001

(54) ENGINE CYCLE AND FUELS FOR SAME

(75) Inventors: Steven C. Amendola; Phillip J. Petillo, both of Ocean, NJ (US)

(73) Assignee: Millennium Cell, L.L.P., Eatontown, NJ (US)

( * ) Notice: Subject to any disclaimer, the term of this patent is extended or adjusted under 35 U.S.C. 154(b) by 0 days.

(21) Appl. No.: 09/559,024

(22) Filed: Apr. 27, 2000

(51) Int. Cl.[7] ..... F01K 3/00; F01K 25/08

(52) U.S. Cl. ..... 60/509; 60/514; 60/515; 60/649; 60/651; 60/671

(58) Field of Search ..... 60/508, 509, 514, 60/515, 649, 651, 670, 671, 673

(56) References Cited

U.S. PATENT DOCUMENTS 3,969,899 * 7/1976 Nakazawa et al. ..... 60/670
4,024,715 * 5/1977 Scragg et al. ..... 60/508 X
4,069,664 * 1/1978 Elliion et al. ..... 60/258
4,322,946 * 4/1982 Murch et al. ..... 60/203.1
5,804,329 9/1998 Amendola .

* cited by examiner

*Primary Examiner*—Hoang Nguyen
(74) *Attorney, Agent, or Firm*—Baker Botts L.L.P.

(57) ABSTRACT

An engine cycle that is carried out in a reciprocating piston/cylinder engine consists of a working stroke in which exothermic decomposition of at least one liquid compound is caused to occur without combustion so as to produce a gaseous product of the decomposition that drives the piston along the cylinder in one direction and an exhaust stroke in which the products of the decomposition are exhausted from the cylinder upon return movement of the piston.

11 Claims, 2 Drawing Sheets

ENGINE CYCLE AND FUELS FOR SAME

BACKGROUND OF THE INVENTION

Engines have provided an invaluable service to mankind by performing work at a rate that is many times what man can do. Over about 200 years, piston engines have evolved into quite sophisticated devices for converting heat energy into motive force. Steam engines were developed first. Here heat is provided to an external boiler to produce a reservoir of hot steam. The steam is admitted into a cylinder with a movable piston, which then moves, consuming energy from the steam and exerting force on a crankshaft. Later, internal combustion engines were developed. These engines take in air and mix it with a fuel. The fuel/air mixture is ignited in a cylinder with a movable piston to provide hot combustion gases that exert a force on the piston, which in most engines is coupled to and drives a crankshaft. Internal combustion engines, in particular, are relied upon for a wide variety of applications, inasmuch as they are in many ways more convenient than their steam counterparts, especially for mobile applications where high power to weight ratios are necessary. There are two types of engines, which are classified by their cycles.

Two-stroke cycle engines tend to be high power, high speed, and simple, but dirty and inefficient. They have high power for their size, inasmuch as the power stroke occurs twice as often for any given speed of crankshaft rotation, compared to four-stroke cycle engines. Two-stroke engines tend to be dirty and inefficient because intake and exhaust are not accomplished by separate strokes but rather are accomplished by slot(s) in the bottom the cylinder which allow the exhaust gases to leave and fresh air and fuel to be inducted. Since this is done in a very short amount of time, exchange of the gases is incomplete, leading to inefficiency. Further, although there are other methods of lubrication, most 2-stroke engines are lubricated by addition of the lubricating oil to the fuel itself. The oil is, therefore, also burned in an inefficient pollution-creating manner.

Four-stroke cycle engines are by far the most commonly used engines. They have separate intake and exhaust strokes as well as a power stroke and a compression stroke. The separation of intake and exhaust ensures intake of sufficient air to complete combustion of the fuel and almost complete exhausting of combustion products. However, the power strokes only occur once in each four piston strokes, as compared to once in every two stokes in two-stroke cycle engines, so the power is less for the same size and speed of the engine. While the four-stroke engine runs cleaner and consumes fuel more efficiently, other things occur that make a four-stroke engine run with about the same net efficiency as a two-stroke engine. For one thing, in a four-stroke cycle engine, energy is consumed in the intake and exhaust stroke as well as the compression stroke. (The exhaust stroke uses energy, but it is small compared to that used in the intake and compression strokes.)

The two major types of four-stroke cycle engines, the Otto cycle and the Diesel cycle, differ only in how the ignition of the fuel is accomplished, the compression ratios and the method of delivering fuel to the cylinders. The energy and power considerations remain the same.

It is well known from thermodynamic laws that there is a direct correlation between the maximum available efficiency of an engine verses its compression ratio. The diesel engine has the advantage in efficiency with its higher compression ratio. For this discussion, however, the more general term "expansion ratio" will be used, since this is actually what produces power and determines efficiency. Furthermore, since the present invention has no compression stroke, as described below, the notion of a compression ratio is not applicable.

The (ideal) work available from a fixed amount (in this case one mole) of gas at a given temperature T (in degrees Kelvin) expanded in volume at an initial pressure P1 to a final pressure P2 is given by Equation 1.

$$W=RT\ln(P1/P2) \tag{1}$$

The units chosen for R, the universal gas constant, determine the units that the energy is expressed in. If Joules are desired, then R=8.314. One uses ideal equations, inasmuch as that gives a maximum obtainable, and it is correct to compare maximums to see if a potential improvement is obtainable. In a real engine many other variables come into play. One important factor, in particular, is the ratio of the specific heat at constant temperature and constant pressure of the gases in the cylinder. However, these gases are dictated by the choice of fuel and therefore are not a variable for an engine cycle according to the present invention. The equivalence ratio is a variable and can effect the Cp/Ct ratio. That is discussed below.

For any given temperature, the ratio of the beginning and ending pressures (which is the expansion ratio) determines how much energy can be extracted. In a conventional two- or four stroke cycle engine, equation (1) also calculates the amount of energy required to compress the gases during the compression stroke. If T were constant one would not expect to extract any energy from such a system. The reason net energy is extracted is that T for combustion during the power stroke is much higher than T for the compression stroke. The intake and exhaust strokes consume much less energy since the chamber is open to the atmosphere and the pressure differentials (P1/P2) are much smaller.

SUMMARY OF THE INVENTION

An object of the present invention is to provide a high power, high efficiency engine cycle that is carried out in a reciprocating-piston engine. Another object is to provide an engine cycle that operates with no pollution or very low pollution by virtue of the nature of the "fuels" used. By utilizing a different set of fuels in combination with an engine constructed to utilize the power cycle of the present invention, many problems common to today's fossil fuel, air-aspirated, piston engines, are eliminated. The engine cycle of the present invention has been named the "Amendola cycle," and an engine operating with the Amendola cycle is sometimes referred to hereinafter as the "ACE."

The Amendola cycle is carried out in a reciprocating piston/cylinder engine and consists of a working stroke in which exothermic decomposition of at least one liquid compound is caused to occur without combustion and produce a gaseous product of the decomposition which drives the piston along the cylinder in one direction, and an exhaust stroke in which the products of the decomposition are exhausted from the cylinder upon return movement of the piston. The decomposition of the liquid compound may be produced by catalysis in the engine cylinder chamber or a chamber in free communication with the cylinder chamber or in a pressure vessel separate from the engine and communicating with the cylinder chamber through a valve. Alternatively, decomposition of the liquid compound may be produced by heating the liquid compound, again in the cylinder chamber, a chamber freely communicating with the cylinder chamber, or a separate pressure vessel.

As described below, it is possible—and it may be advantageous—to use a plurality of liquid compounds in the power stroke. When liquid compounds cannot be mixed, one liquid compound is decomposed in a first pressure vessel separate from the engine and a second liquid compound is decomposed in a second pressure vessel separate from the engine and separate from the first pressure vessel.

Suitable compounds for use in an ACE include hydrogen peroxide, hydrazine, ammonium azide, hydrazinium azide, hydrazinium nitrate, ammonium nitrate, ammonium perchlorate, and amine-nitrocompounds. In some cases, the liquid compound(s) is a substance(s) dissolved in water. It is possible, and may be advantageous, to use a substance in the working stroke that reacts with a product of the decomposition of the liquid compound(s).

The Amendola cycle begins with "fuel" injection as the piston approaches Top Dead Center (TDC) in the cylinder. As mentioned above, the fuel may have been decomposed exothermically in a separate pressure vessel, in which case it is injected as a pressurized gas, or it may be injected from a supply tank before decomposition, in which case it decomposes in the cylinder chamber of the engine or a chamber or cannister in free communication with the cylinder chamber.

As the fuel is injected into the closed chamber, the pressure builds up and drives the piston down. The ideal work performed will be that as calculated by equation (1) above. When the piston nears or reaches Bottom Dead Center (BDC), the exhaust value now opens so that the gases may be pushed out of the cylinder as the piston rises back to the top. As the piston approaches TDC the exhaust valve closes and fresh fuel is injected to start the next cycle. As can be seen the ACE full cycle is completed in two strokes (one down, one up) and, therefore, the ACE will have the higher power to volume (and therefore, weight) ratio compared to a four-stroke engine.

However, since a complete and separate exhaust stroke is incorporated in the ACE, the cleaner-operating and efficient use of fuel obtainable in a four-stroke engine is also achieved. Further, since no compression stroke required, the energy consumed on this stroke is eliminated, thereby increasing the overall cycle efficiency several percent above Otto, Diesel or two-stroke engines.

Another advantage of the engine cycle of the present invention is that the expansion ratio can be made quite high if desired for high efficiency engines. In existing engines the expansion ratio is the same as, and therefore limited by, the compression ratio, which in turn, is limited by the quality of the fuel used. This fuel quality is expressed as an "octane number" for spark ignition engines and a "cetane number" for compression ignition engines. Most spark ignition engines rarely exceed compression ratios of 12:1 with between 8:1 to 10:1 being the most common. With compression ignition 20:1 ratios are possible with 14:1 to 18:1 being the most common. However, the more efficient compression ignition engines are only efficient at rather steady conditions and respond poorly to load changes. This lowers the desirability of using diesels in transportation since they emit large amounts of pollutants while the load conditions are changing.

With the ACE, since there is no compression stroke, there is no preignition of the fuel (the key limiting factor of compression ratio) and the expansion ratio can be made as high as desired. The only limitation is the mechanical ability to make a large expansion ratio. In practice the ideal efficiency for a 10:1 system according to equation (1) would give work of, RT(2.3). A 100:1 system would give RT(4.6). So a ten-fold increase in compression ratio doubles the extracted work. However, even just going to 30:1 gives RT(3.4), a 50% increase in work output.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENTS

Figure 1:
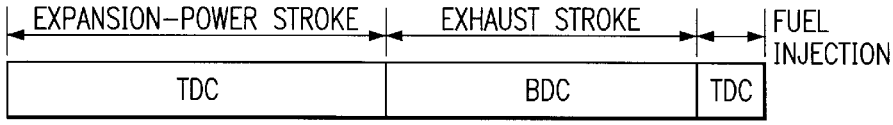
FIG. 1 is a diagram of the Amendola cycle.

The Amendola cycle, as depicted diagrammatically in FIG. 1, consists of an expansion-power stroke that begins at Top Dead Center TDC and continues to near to or at Bottom Dead Center BDC, at which point an exhaust valve(s) is opened. From BDC to a few degrees before TDC, the engine piston drives exhaust gases out through the open exhaust valve(s). A few degrees, for example, about 15 degrees, before TDC, the exhaust valve is closed and fuel is introduced into the cylinder.

As with other engines, the operation of the ACE requires a fuel that is suitable for the engine. This is analogous to gasoline being required for spark ignition, "Otto" engines but not being suitable for a diesel engine, which requires diesel fuel. For the present invention, a fuel that does not require the intake of air (oxygen) or any other gas is required. It must, however, produce a large quantity of gas in a very short period of time. One such fuel is hydrogen peroxide. It is energetic and very clean. It decomposes exothermically by the following equation $$H_2O_2=H_2O+\tfrac{1}{2}O_2(2.87\ \text{kJ/gram}) \quad (2)$$

As can be seen the only exhaust products are water (steam) and oxygen. Those exhaust products are not only very clean but actually beneficial due to the oxygen release. Reaction (2) can be catalyzed by either heat or by one of several catalysts known to promote peroxide decomposition. Typical catalysts are high surface area compounds or metals containing silver or manganese or other materials, usually transition metals. Several other fuels suitable for the ACE engine will have the characteristic of being decomposed by a catalyst.

Another method of decomposing hydrogen peroxide is heat. A heat source similar to a glow plug used in the cold starting of diesel engines is suitable. Since the reaction is exothermic, the glow plug will be heated initially by an electrical input, but will then be able to stay hot on its own after a short time, without electrical input, and still be able to sustain the reaction at a sufficient rate.

Several other fuels suitable for this engine will have the characteristic of being decomposed by heat.

The engine will have an injector that will inject fuel into the cylinder at the proper timing. Timing can be achieved by any method, mechanical or electronic, as suitable for the engine. Alternatively, the injector can admit the pressurized products of the chemical reaction, which is performed in another chamber and distributed to the engine cylinders as required. It should be noted that timing of fuel injection is used for both power and efficiency purposes, as desired. However, the ACE has the unusual characteristic that if no timing of the fuel were used, the engine would still run. The reason for this is that if a fuel were to be constantly pumped in, it would produce the gas required to push the piston(s) down. Then, when the exhaust valve opens, even though fuel would still be coming in (when it shouldn't be), the gases from the reaction would simply be wasted by going out the exhaust valve while the piston was traveling up. In other words the fact that a reaction may still be taking place for whatever reason is not sufficient to prevent the piston from rising on the up stroke since the valve is always open on every up stroke. Then once the piston arrived at the top, the valve would close allowing the cycle to repeat. So even though this would clearly be wasteful of fuel, the engine would still run.

Decomposition of the fuel in the cylinder in a very short time (less than about 10 or 15 degrees of rotation) by a catalyst or heat source within the engine cylinder is the most efficient way of running the ACE. However, to increase the versatility of the ACE and the variety of fuels, a slightly different system of delivering the decomposition products may be required. As mentioned above, the fuel may be metered into an external reaction chamber where the decomposition takes place. A certain pressure may be maintained in this chamber. When a fuel-delivery valve opens, the high pressure gases will enter the cylinder and force the piston down. This method has some advantages and some disadvantages. The key disadvantage is that a good portion of the energy of the fuel shows up as heat in the products. This heat, in the form of the hot gases, must be delivered to the cylinder to be utilized. Therefore, the reaction chamber and the plumbing that connect the reaction chamber to the cylinder should be thoroughly insulated for good efficiency.

One advantage of a system in which the fuel is exothermically decomposed in a pressure vessel separate from the engine cylinder is that a wider variety of fuels and catalysts become available for use. A slower catalyst in a separate pressure vessel can still keep up with the average rate of fuel delivery required for the engine. The fact that gas is always present at the needed pressure will then allow the engine to operate. Another advantage of using a separate decomposition vessel is that the timing of when to inject the fuel is not as critical. All that is necessary is that a desired pressure range be maintained. For example, a maximum pressure of 250 psi and minimum pressure of 220 psi may be desired. Injection of Hydrogen peroxide into the decomposition vessel can be initiated when the pressure reaches near 220 psi. If a time lag were involved, a precalculated amount that gives the proper pressure can be injected or time allowed between the injections to insure that the maximum pressure is not exceeded. As the pressure reaches 250 psi, a pressure switch shuts off the flow of fuel to the decomposition vessel. As the engine operates, it will draw down the pressure in the vessel. When the pressure reaches 220 psi, the pressure switch turns on the fuel flow until 250 psi is reached as before. Therefore, the metering of the fuel now becomes independent of the timing of the engine. Only the usage of the engine triggers fuel flow. In this configuration since gas is entering the cylinder, instead of the fuel, a different timing and a different orifice will be required.

The engine may also use more than one fuel or of fuel that is a mixture of suitable compounds. As an example when hydrogen peroxide is used, the reaction products contain oxygen. This condition is referred to as a compound with a positive oxygen balance. This means that another fuel that can consume the oxygen would deliver more energy. This may or may not be desirable, but it is certainly feasible and can be done where it is desirable. As an example, with hydrogen peroxide, another fuel such as ammonia could be simultaneously injected. Now, the extra oxygen will be consumed by the ammonia, producing additional steam and energy. If the fuel is chosen so as not to contain carbon, the engine will still qualify as a ZEV (zero emission vehicle) in most cases, so although a fuel such as methanol can be used in conjunction with hydrogen peroxide, the resulting carbon dioxide in the exhaust would qualify as a greenhouse gas emission.

As mentioned above, the equivalence ratio can be adjusted to maximize efficiency. In ordinary IC engines the definition of equivalence ratio is that 1.0 equals the stochiometric ratio of air to gasoline to provide the exact amount of oxygen required to just turn the gasoline into carbon dioxide and water. In the ACE no air is taken in, but an equivalence ratio nevertheless can be established if more than one component is used for the injected fuel mixture. So in the case of hydrogen peroxide with its excess oxygen content, fuel can be added to adjust the equivalence ratio closer to 1. In the case of ammonia the equivalence ratio of 1 would be obtained when only nitrogen and water were products of the exhaust. However, in a real engine an equivalence ratio of 1 is not always optimal or desired depending on the application. In the above example an equivalence ratio of 1 would usually result in some unreacted ammonia in the exhaust.

In order to use more than one fuel compound, one of two methods is suitable. The first is to use a separate tank for each component and a separate injection system for each as well. This is the safest and most versatile method, but it is also more complex and therefore more costly. The second method is to premix the two components into one and store the mixture in the tank. Then only one injector system is required. One disadvantage of a mixture is that the two components may not be compatible with or soluble in each other. Another problem is that mixtures of fuels and oxidizers together always have the potential of being explosive. While it is desired to have a rapid reaction in the cylinder for the operation of the motor, clearly it is undesirable to the same reaction take place in the storage tank. So any mixtures should be thoroughly tested to prove the safety of mixing the components together.

Another, big advantage of an ACE is that certain of the fuels can be made with simple compounds and some energy. As an example, hydrogen peroxide requires only water and air (oxygen) and electricity for its production. This is important since almost every household has these components. One of the big stumbling blocks to new fuels is the lack of wide spread availability of the alternate fuel. Gasoline has a 100-year head start on all the other fuels. It is understandable that any company does not want to invest in the distribution of a fuel that may never be popular. However, the initial people who wish to buy peroxide powered cars can also just buy a plug-in "box" that makes hydrogen—peroxide then a big question mark has been removed. When a certain number of peroxide cars are on the road, companies will be able to justify the distribution of hydrogen peroxide on a large scale. This makes sense since the gasoline infrastructure didn't appear overnight—neither would one expect any other infrastructure.

Fuels suitable for an ACE operating on one pure compound include but are not limited to the following: hydrogen peroxide, hydrazine, ammonium azide, hydrazinium azide, hydrazinium nitrate, ammonium nitrate, ammonium perchlorate, and amine-nitrocompounds. Compounds that are not themselves liquids can be dissolved in water for convenience.

For multi-component systems more fuels are suitable. If hydrogen peroxide is the main component then any fuel that uses the excess oxygen can enhance the energy. One fuel in particular, hydrogen gas, will give a very clean reaction as follows:

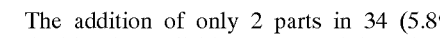

$$H_2O_2+H_2=2H_2O \text{ (5.9 kJ/gm)} \quad (3)$$

The addition of only 2 parts in 34 (5.8%) of hydrogen doubles the available energy, and the exhaust is now totally water. To insure the completeness of this reaction, a spark ignition system or platinum catalyst are included in the combustion chamber. Although this requires hydrogen storage, it requires much less volume, thus alleviating some of the problems. High density hydrogen storage is available is various systems including borohydride, as described by Amendola in U.S. Pat. No. 5,804,329, which is incorporated herein by reference.

An additional advantage of an ACE is that it will operate in environments with little or no air, such as underwater, in the upper stratosphere or even outer space, wherever power may be required. Another novel application of the Amendola cycle is in a dual fuel mode. An engine can be configured to operate as an ordinary air-aspirated engine as well as an Amendola cycle engine. This is accomplished by providing intake valves to operate in both modes as required. When in the Amendola cycle mode, an intake valve stays closed all the time and the exhaust valve opens on every up stroke. In the conventional mode, the intake valve is timed to open on every other down stroke and the exhaust valve opens on every other upstroke. This can be accomplished by either mechanical or electronic means. An engine is now created which can operate in both modes. During the conventional operation the intake valve and spark plug operate, and the catalyst while present is not used. In the Amendola cycle mode the spark plug and intake valve are not used, but the fuel injector and catalyst are.

The advantage of the above configuration is that a single engine is created which can operate in almost all environments. As an example, in some submarines different power sources are utilized, depending on whether the submarine is submerged or on the surface of the water. Although submarines can snorkel for air, that is limited to fairly shallow depths. With the dual fuel ACE the submarine can travel on the surface using, say, air and diesel fuel, but when it submerges, the engine can use hydrogen peroxide—both modes using the same power plant. So another engine is not required. Another advantage is also logistical. If one fuel is in short supply, the other fuel will operate the engine when needed.

A reciprocating piston engine using the Amendola cycle may be mechanically very much like a conventional Otto cycle engine except for the fuel supply system and the valve arrangement. For the sake of simplicity of description and illustration (see FIG. 2), a single cylinder engine is described and shown. A multi-cylinder engine will merely have several cylinders and pistons and associated crank arms, valves and valve cams suitably timed to operate sequentially.

Figure 2:
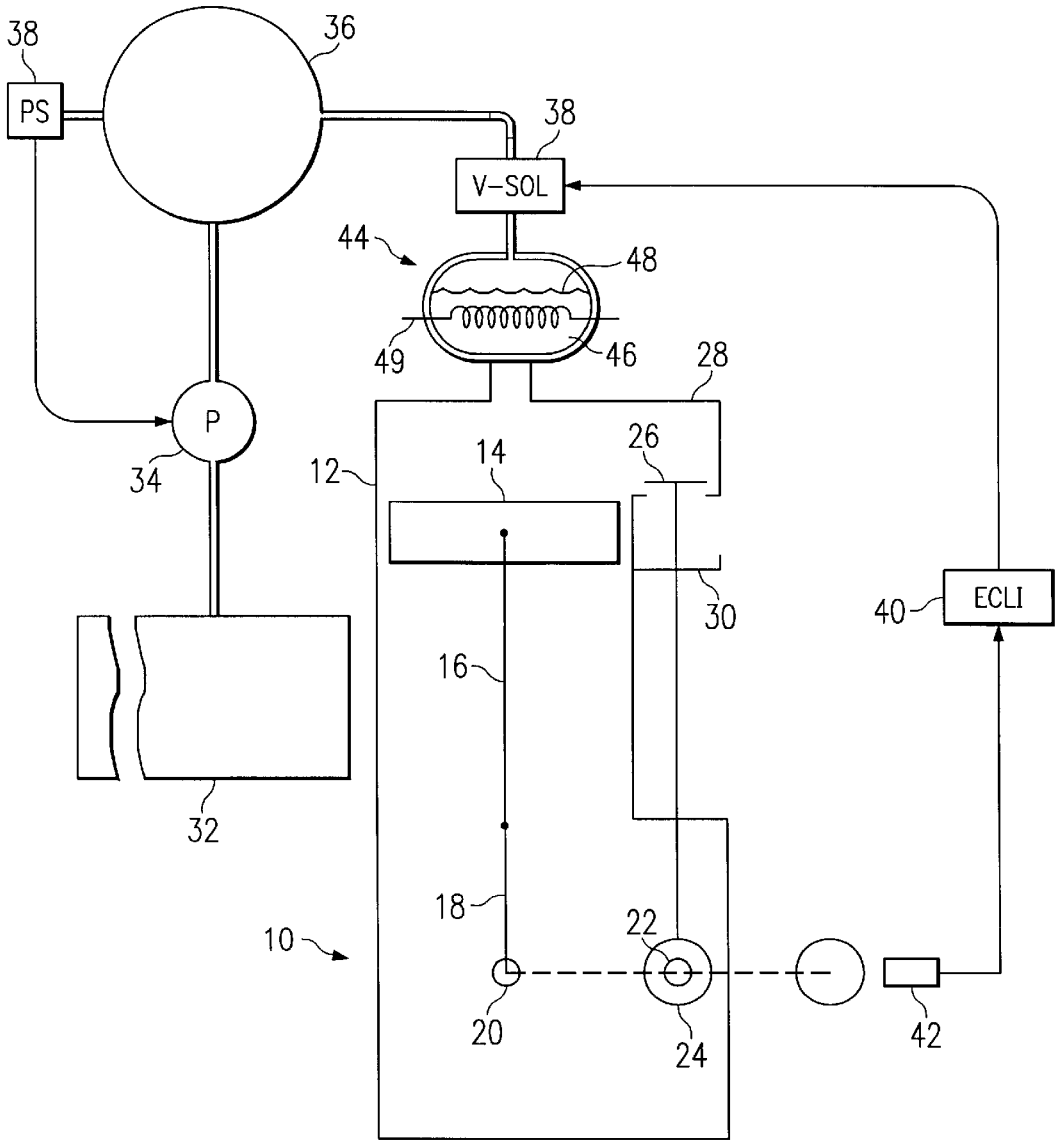
FIG. 2 is a schematic cross-sectional view of an ACE and the fuel system associated with it.

As FIG. 2 shows, the engine 10 has a cylinder block and head forming a cylinder chamber 12, which receives a reciprocating piston 14. The piston is coupled by a piston rod 16 to a crank arm 18 carried by a crank shaft 20. The crank shaft is coupled to a cam shaft 22 that has a cam 24 for opening and closing a valve 26. When the valve is open during the exhaust stroke, exhaust gas driven from the cylinder chamber 12 by the piston passes through an exhaust runner 28 in the engine head to an outlet channel and port 30. The camshaft-actuated valve of the engine 10 of FIG. 2 can be replaced by a solenoid-actuated exhaust valve communicating with an exhaust port in the cylinder and controlled by the ECU.

Fuel stored in a fuel tank 32 is pumped by a pump 34 to a pressure vessel 36, which may contain a trapped gas in the upper portion to act as an accumulator. A pressure switch 38 controls the pump 34 to maintain the pressure in the vessel 36 within predetermined upper and lower limits, say from 80 to 100 psia. The pressure need not be high, inasmuch as the cylinder chamber is at near atmospheric pressure when the fuel is delivered.

Fuel is injected into the cylinder chamber 12 from the pressure vessel 36 by opening an electrically activated solenoid valve 38. An electronic control unit (ECU) 40, is triggered by an optical encoder and encoder wheel 42. The ECU opens the solenoid valve at the correct time and for the correct length of time to deliver the proper amount of fuel from the pressure vessel 36 to the cylinder chamber 12.

Let it be assumed now that the fuel is hydrogen peroxide. The hydrogen peroxide is reacted with a catalyst contained in a catalyst canister 44 located immediately adjacent the engine head and downstream from the solenoid valve 38. The catalyst can be any form but in this example is very fine silver wool obtained from Aldrich Chemicals and treated with a solution of samarium nitrate. The wetted wool is placed in an oven for 14 hours at 300 degrees Celsius. The catalyst wool mass 46 is retained in the cannister 44 by screens 48. This cannister makes a very effective and long-lived catalyst system for hydrogen peroxide decomposition. (It should be noted that hydrogen peroxide is often provided with stabilizers, which should be removed prior to use for optimum performance.) Injection of the hydrogen peroxide into the cannister initiates the exothermic decomposition of the hydrogen peroxide by catalysis, which produces gas under pressure (steam and oxygen) that pushes the piston 14 down during the expansion-power stroke. The solenoid valve 38 closes under the control of the ECU 40 after a predetermined fuel-injection period.

After the piston 14 has been pushed down by the gases and is near or at bottom dead center BDC, the valve 30 is opened and remains open as the piston is pushed back up by the crankshaft/crank arm 18/20. When the piston is a few degrees ahead of TDC, the valve 14 is closed, and the engine is ready for the injection of more hydrogen peroxide and the next power stoke.

In addition to or in lieu of providing a catalyst cannister, the inner surface of the engine head and the top of the piston may be coated with a catalyst. The head end of the piston may have a cavity in which a catalyst in a suitable mechanical form is installed.

The catalyst systems for canisters, piston and cylinder head cavities, and decomposition vessels may be made of a solid metal catalyst in the form of a coating, a screen (fine mesh wire cloth), a wool (like steel wool), beads or other small particles, and sintered layers. Loose forms such as wool and beads may be retained by screens and filters backed by screens.

Exothermic decomposition of the fuel supplied to the engine may also be produced by a heat source contained in the cylinder chamber above the top dead center position of the piston, as mentioned above. As shown in FIG. 2, a heating element 49 may be installed in the catalyst cannister 44 to enhance the decomposition of the fuel by the combined effects of catalysis and heating of the fuel. Similarly, a glow plug may be installed in the cylinder head.

Figure 3:
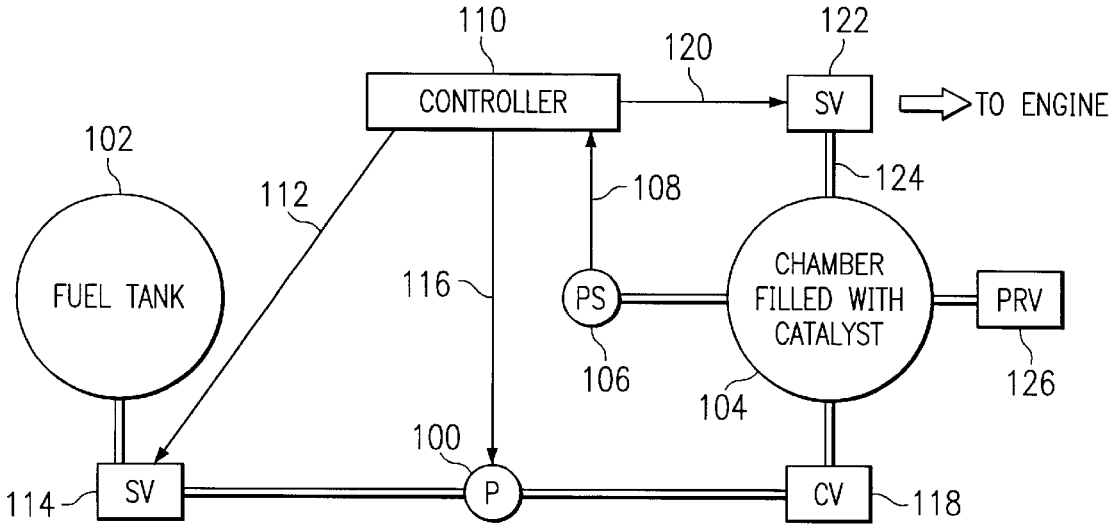
FIG. 3 is a schematic drawing of fuel supply and decomposition apparatus for producing pressurized gas for delivery to a piston/cylinder.

In an alternative fuel supply and decomposition apparatus for use with a piston/cylinder engine, such as that shown in FIG. 2, which is illustrated schematically in FIG. 3, fuel is periodically pumped by a pump 100 from a fuel storage tank 102 into a decomposition vessel 104, which is a pressure vessel that contains a catalyst for the fuel. A pressure sensor 106 senses the pressure in the vessel 104 and supplies a pressure signal through a conductor 108 to a controller 110. When the pressure in the vessel 104 drops to a predetermined level, the controller sends a signal through a conductor 112 to a solenoid valve 114 and through a conductor 116 to the pump 100 to open the solenoid valve and turn on the pump. A check valve 118 prevents backflow of pressurized gas from the decomposition vessel 104 in the line from the pump to the vessel. When the pressure in the vessel 104 rises to a predetermined level, or after a predetermined pumping time, the controller closes the valve 114 and turns off the pump 100. The controller 110, in response to signals indicative of the stroke of the engine (see, e.g., the sensor 42 of FIG. 2) and engine throttle signals indicative of the power demanded from the engine, supplies signals through a conductor 120 to a solenoid valve 122 in a gas supply conduit 124 leading to a gas supply port in the head of the engine. The valve 122 is of a type that regulates the gas flow, thus enabling the quantity of gas supplied to the engine to be varied. A pressure relief valve 126 provides for release of gas from the decomposition vessel 104 in the event that the pressure exceeds a predetermined level.

Figure 4:
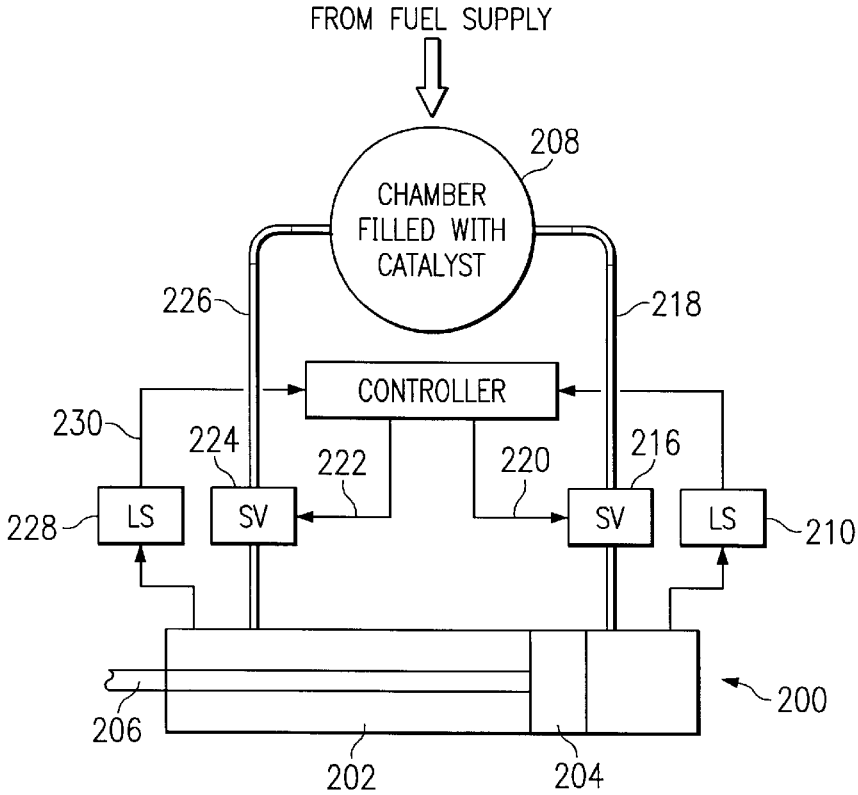
FIG. 4 is a schematic drawing of a double-acting reciprocating piston engine suitable for the ACE.

The engine shown schematically in FIG. 4 is based on a piston/cylinder 200 having a cylinder 202 and a piston 204 that is affixed to a piston rod 206, which leads out of the cylinder 202 and is coupled outside the cylinder to a suitable output mechanism (not shown) for driving a load (also not shown). The fuel delivery and supply system for the piston/cylinder 200 may be of either the type shown in FIG. 2 or the type shown in FIG. 3—the type of FIG. 3 is illustrated. In coordination with each stroke of the piston, pressurized gas from a decomposition chamber 208 is supplied to the then top dead center end of the cylinder 202. In the position shown in FIG. 4, for example, a limit switch 210 detects the arrival of the piston 204 at the right end of its rightward stroke and supplies a signal over line 212 to a controller 214. During the rightward stroke, a three-way solenoid valve 216 of a type enabling control of the inflow from the vessel 208 to the cylinder through the conduit 218 has been open to an exhaust position, which allowed gas in the right section of the cylinder to escape. Upon the arrival of the piston at the right TDC position, the solenoid valve 216 is cycled by supply of a signal over line 220 from the controller to close the exhaust and open the conduit 218 to regulated flow of pressurized gas from the vessel 208, thereby initiating a leftward working stroke of the piston 204 along the cylinder. At about the same time, a signal over line 222 from the controller cycles a three-way regulatable solenoid valve 224 in a conduit 226 from a position allowing gas to flow from the vessel 208 into the left section of the cylinder to a position allowing gas to be exhausted from the left section of the cylinder. In the above state, the engine delivers a leftward working stoke. At the end of the leftward stroke, a limit switch 228 supplies a signal over line 230 to the controller, indicating that the piston has reached the left TDC position. The controller terminates the leftward working stroke and initiates a rightward working stroke by cycling the valves 224 and 216 for supply of gas from the vessel 208 to the left section of the cylinder and exhaust from the right section. The timing of the cycling of the valves 216 and 224 with respect to the position of the piston can, of course, be programmed into the controller so that supply of pressurized gas begins ahead of each TDC position. The signals from the limit switches are indicative of the duration of each stroke, so cycling of the valves can readily be timed to a fraction of the stroke duration.

An engine based on a piston/cylinder with a piston rod extending out of the cylinder (like FIG. 4) can be single/acting and provided with a mechanical spring or an accumulator for the return stroke. A single-acting rod/piston/cylinder engine may also operate in opposition to a counterpart engine, in which case the counterpart provides the return stroke.

What is claimed is:

1. An engine cycle carried out in a reciprocating piston/cylinder engine and consisting of a working stroke in which exothermic decomposition of at least one liquid compound is caused to occur without combustion so as to produce a gaseous product of the decomposition which drives the piston along the cylinder in one direction, and an exhaust stroke in which the products of the decomposition are exhausted from the cylinder upon return movement of the piston.

2. An engine cycle according to claim 1, wherein the decomposition of the liquid compound is produced by catalysis.

3. An engine cycle according to claim 2, wherein the decomposition of the liquid compound takes place in the cylinder chamber or a chamber in free communication with the cylinder chamber.

4. An engine cycle according to claim 2, wherein the decomposition of the liquid compound takes place in a pressure vessel separate from the cylinder chamber and communicating with the cylinder chamber through a valve.

5. An engine cycle according to claim 1, wherein the decomposition of the liquid compound is produced by heating the liquid compound.

6. An engine cycle according to claim 1, a plurality of liquid compounds are used in the power stroke.

7. An engine cycle according to claim 6, wherein one liquid compound is decomposed in a first pressure vessel separate from the engine and a second liquid compound is decomposed in a second pressure vessel separate from the engine and separate from the first pressure vessel.

8. An engine cycle according to claim 1, wherein the liquid compound is a member of the group consisting of hydrogen peroxide, hydrazine, ammonium azide, hydrazinium azide, hydrazinium nitrate, ammonium nitrate, ammonium perchlorate, and amine-nitrocompounds.

9. An engine cycle according to claim 8, wherein the liquid compound is a substance dissolved in water.

10. An engine cycle according to claim 1, wherein the liquid compound is hydrogen peroxide.

11. An engine cycle according to claim 1, wherein a substance that reacts with a product of the decomposition of the liquid compound is supplied to the cylinder chamber during the working stroke.

* * * * *